US006694883B2

(12) United States Patent
Hauck

(10) Patent No.: US 6,694,883 B2
(45) Date of Patent: Feb. 24, 2004

(54) METHOD OF CORRECTING LOCAL, MACHINE-BASED INKING ERRORS IN ROTARY PRINTING MACHINES

(75) Inventor: Axel Hauck, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 217 days.

(21) Appl. No.: 09/944,578

(22) Filed: Aug. 31, 2001

(65) Prior Publication Data

US 2002/0043172 A1 Apr. 18, 2002

(30) Foreign Application Priority Data

Aug. 31, 2000 (DE) ..... 100 42 680

(51) Int. Cl.[7] ..... B41L 39/00
(52) U.S. Cl. ..... 101/484; 101/483
(58) Field of Search ..... 101/484, 483

(56) References Cited

U.S. PATENT DOCUMENTS 5,806,430 A * 9/1998 Rodi ..... 101/484
6,220,157 B1 * 4/2001 Delwiche et al. ..... 101/178

* cited by examiner

*Primary Examiner*—Charles H. Nolan, Jr.
(74) *Attorney, Agent, or Firm*—Laurence A. Greenberg; Werner H. Stemer; Gregory L. Mayback

(57) ABSTRACT

First, the inking behavior of the printing units of a multicolor rotary printing machine is determined by means of test forms. The inking nonuniformities on the test forms are transmitted to the pre-press stage. Using the data about the inking nonuniformities of the test forms, the raster tonal values of the color separations of a printing form are modified in such a way that the inking nonuniformities are compensated locally on the basis of the location of their occurrence in the print on the printing forms or films.

12 Claims, No Drawings

METHOD OF CORRECTING LOCAL, MACHINE-BASED INKING ERRORS IN ROTARY PRINTING MACHINES

BACKGROUND OF THE INVENTION

Field of the Invention

The invention lies in the printing technology field and pertains, more specifically, to a method of correcting local, machine-based inking errors on rotary printing machines, which can occur as stripe formation, ink fading or as ghosting in the finished printed product, reducing its quality.

In an offset printing process, because of the construction of the offset printing unit, it is not possible to ink a printed sheet completely uniformly or, in the case of a predefined subject, to ink the raster points with a constant layer thickness. Using an offset printing unit, the inking of a printing plate clamped onto the circumference of a plate cylinder is indeed carried out continuously with an ink film, which has been reduced to a specific ink film thickness by a multiplicity of distributor or bridging rolls. However, the ink uptake takes place discontinuously, since, firstly, the ink uptake depends on the subject and, secondly, the circumferential face of the plate cylinder accommodating the printing plate is discontinuous as a result of the clamping channels.

Disruption to the ink transfer, for example at the interface from the inking unit to the surface of the plate cylinder discharging the ink to the transfer cylinder, at the interface between the printing plate cylinder and the transfer cylinder surfaces and also at the interface between the surface of the transfer cylinder, which is most often formed as a rubber blanket covering, and the printing material to be printed leads to nonuniformities. These can have an effect both on the ink layer thicknesses transferred and, in relation to the raster areas, on the point size produced. The effects which result from this are stripe formation, ink fading in the printing direction and ghosting effects. The relationships between these phenomena which occur in the inking unit are quite complex and cannot be considered in isolation from one another.

In order to achieve high uniformity in the course of the ink density or the ink layer thickness in the print, these effects are taken into account to the greatest extent, in the context of simulation programs and design principles, in the design of inking units on rotary printing machines, and the inking unit is optimized in relation to the effects mentioned. Furthermore, there is the possibility of influencing these errors, for example by means of distributor rolls used in the inking unit and the point at which they start operating. In addition, the selection of suitable transfer covering surfaces functioning as transfer cylinder covers, such as rubber blankets, permits the occurrence of dynamically caused stripes to be reduced. However, the specific local correction of inking non-uniformities in the print cannot be achieved with these measures.

SUMMARY OF THE INVENTION

It is accordingly an object of the invention to provide a method of correcting inking errors in rotary printing machines, which overcomes the above-mentioned disadvantages of the heretofore-known devices and methods of this general type and which allows correcting machine-based inking errors locally.

With the foregoing and other objects in view there is provided, in accordance with the invention, a method of correcting local, machine-based inking errors in a rotary printing machine, which comprises the following method steps:

- determining an inking behavior of a printing unit by means of test forms;
- registering inking nonuniformities on the test forms and transmitting data concerning the inking nonuniformities to a pre-press stage; and
- modifying raster tonal values of the color separations of a printing form such that the inking nonuniformities are anticipated locally based on a location of their occurrence in the print on the printing forms or printing films.

In other words, the method corrects local, machine-based inking errors on rotary printing machines by executing the following steps:

- determining the inking behavior of the printing units by means of test forms;
- registering the inking nonuniformities on the test forms and transmitting the data about inking nonuniformity to the pre-press stage; and
- modifying the raster tonal values of the color separations of a printing plate in such a way that the inking nonuniformities are compensated locally on the basis of the location of their occurrence in the print on the printing plates or films. The advantages which result from the solution proposed according to the invention can primarily be seen in the fact that disruptive stripes in the finished printing product, the ink fading in the printing direction and ghosting effects are no longer visually perceptible, or only to a slight extent. It is already possible to take account of the printing or inking behavior of the printing plate in a machine-specific way in the pre-press stage, i.e., during make-ready, so that the nonuniformity effects which set in later during the inking of the surface of the printing plate can be taken into account during the production of the printing plate and are compensated for in the subsequent print. As a result of the method proposed according to the invention, machine-specific characteristics may be maintained not only in global form but locally on the basis of the location of their occurrence, as a function of the raster tonal values, and therefore the quality of the printed product to be produced may be increased significantly.

In accordance with an advantageous development of the method of the invention, the inking behavior of the printing units is determined by means of test forms for the maximum format. The determination for the maximum format offers the advantage of using the latter as a reference value or reference printed product and of being able to convert from the latter to smaller formats from the determined inking nonuniformities. In accordance with an additional feature of the invention, in the case of inking nonuniformities determined independently of printing units, the inking nonuniformity of the rotary printing machine can be determined on only one representative printing unit. This offers the advantage that only one of a number of printing units has to be chosen, so that, during the calibration within the pre-press stage, a time advantage may be achieved by evaluating only one printing unit. In the case of a multicolor printing machine, which, for example, comprises 4, 6 or 8 printing units connected in series one after another, this represents a significant time advantage.

In accordance with another feature of the invention, in the case of subject-dependent inking nonuniformities, the modification of the color separations of a printing plate, be it in plate form or as a printing sleeve or a film, can be carried out on the basis of the subject, using the data from the raster image processor. Subject-dependent inking nonuniformities primarily occur when regions with high raster tonal values and regions with extremely low raster tonal values are located close beside one another in the print. By means of the method proposed according to the invention, it is possible to take into account not only the printing-machine or printing-unit dependent behavior of the production of inking nonuniformities but also the inking nonuniformities which occur as a result of the subject to be printed because of extremely different raster tonal values.

Using the method proposed according to the invention, the determined inking characteristics of the printing units, or of the individual printing units in a multicolor rotary printing machine, can be transferred to the pre-press stage in the form of a profile.

The profiles can be transferred, in particular, in tabular form, which more easily permits their further processing in the pre-press stage, which increasingly operates in digital form.

Also conceivable is the transfer of the inking characteristics in the form of amplitude, gradient, position in the image, etc.

Within the transferred profiles, their resolution is matched to the error gradients of the inking nonuniformities. The solution proposed according to the invention may be kept in reserve in order to modify the raster tonal values when predefining the raster tonal value fluctuations within the pre-press stage during the production of the printing plate. A printing plate to be used later in the corresponding printing unit, be it in plate or in sleeve form, is therefore prepared in such a way that the inking nonuniformities which arise are maintained. In addition, in the case of digital equipment of the corresponding pre-press stage, within the pre-press stage, the modification of the raster tonal values can be used during the image-setting operation in the digital printing-plate image-setting process, for example in computer-to-press (direct imaging) image setting in the printing machine, and also in the digital exposure of films or printing plates.

The inking behavior of a multicolor rotary printing machine, whose individual printing or finishing units are connected one after another, is adequately accurately known following the evaluation of test prints using preceding print jobs. The data from test prints or already present from the preceding print jobs and about the inking nonuniformities with regard to ink fading in the printing direction, ghosting effects which arise as a function of the inking, and also stripe formation, are coupled, by means of the method proposed according to the invention, with the data which accumulate during the production of the printing plate for the respective print job to be carried out.

The inking nonuniformities which arise in accordance with the offset process have their cause in the general effect that, in this printing process, although the feed of ink is carried out continuously, the ink uptake by the transferring surfaces carrying the ink film within the printing unit takes place discontinuously. With the method proposed according to the invention, the machine-based errors during the production of the printing plate are maintained in the form of local raster tonal value changes, so that, in the printed image to be produced, after the printing material has passed through a number of printing units connected one after another, they are subsequently no longer visible or visible to only a restricted extent in the superimposed printed image produced in this way from a plurality of color separations.

If the inking nonuniformities which arise occur only in a printing-unit-specific manner, then, during the characterization, all the printing units of a multicolor rotary printing machine have to be examined with regard to inking nonuniformities, and also the printing plates to be used in the respective printing units have to be maintained differently with regard to the inking nonuniformities.

If the inking nonuniformities which arise are identical from printing unit to printing unit, then, in the case of a multicolor rotary printing machine containing 2, 4, 6, 8 printing units and one or more finishing units, only one printing unit has to be picked out and, as representative for the other printing units, transmitted to the pre-press stage with regard to the transmission of the data about the inking nonuniformity which arises. In this case, it is unimportant whether the pre-press stage operates in digital form or whether, in the conventional manner, the individual printing plates or the color separations for each printing unit are exposed or produced using films.

If, on the other hand, the inking nonuniformities arise in a subject-dependent manner, as is the case in particular in the ghosting effect, the corrections relating to the inking nonuniformities must also be carried out in a subject-dependent manner. During the production of the printing plate in the pre-press stage, the subject is however adequately accurately known during the production of the color separations. Since the data about the production of the subject, that is to say the setting of the image on the printing plate in the pre-press stage, is known, it can be used, given a knowledge of the inking nonuniformities of the printing units of a multicolor rotary printing machine, to determine the corresponding corrections to the inking nonuniformities, and can be taken into account during the production of the corresponding printing plate for each printing unit. In addition to the ghosting effects, other effects, such as the ink fading of the printed product to be produced, could also be subject-independent. In the case of this type of color nonuniformities which occur, the corrections can be carried out globally, that is to say irrespective of the printed image. This means that, during the corresponding production of the printing plate, the raster tonal value generation as viewed over the print length compensates for, that is to say maintains, the ink fading which arises over the printing length if said fading is independent of the subject.

Transferring the inking characteristics of the individual printing units of a multicolor rotary printing machine, or the necessary corrections, to the pre-press stage, can be carried out in the form of a profile, for example a multi-dimensional look-up table. It is possible to imagine coupling the profile to an ICC profile of the printing machine, which describes the inking behavior, to which profile the data to be transmitted to the pre-press stage may also be appended in the form of an attachment. If transferring the correction data to compensate for the inking nonuniformities which arise in each printing unit can be carried out in a standardized manner, then further processing of this data within the pre-press stage likewise has to be carried out in a standard manner during the production of the printing plate, and gives rise to significantly less effort there. The resolution of the color nonuniformities to be transmitted in tabular form can be adapted to the error gradients which occur in each case. In addition to characterizing the inking nonuniformities by means of the error gradients, the ink fading, ghosting and striping effects can also be wherein in more detail by means of the amplitudes and gradients which occur and the location of their occurrence. The more precisely and uniquely the inking nonuniformities which arise in the individual printing units of a rotary printing machine are known, and the more data relating to the occurrence, with regard to the local occurrence of the errors, are known, the more precisely can compensation for these effects be maintained during the production of the printing plate, which leads to the effects which arise in each printing unit subsequently being barely visible or completely invisible in the print.

Correcting the raster tonal values in the raster printing process can be carried out at the pre-press stage at two points during the production of the printing plates. In the event of raster image processor processing of the image data, or during the image-setting operation in a digital plate or film exposer, or in the computer-to-press process, both flat printing plates and sleeve-like printing plates can be exposed. Using the method proposed according to the invention, it is possible to ensure that the location of the correction on the surface of the respective printing plates to be exposed or on which an image is to be set agrees with the location of the occurrence of the error in the print. Only in this way may inking nonuniformities which occur be compensated for locally or be maintained during the production of the corresponding color separation of a printing plate, so that the effects of ink fading which arise, or ghosting effects which arise in the case of subjects tending to ghosting, are compensated for. It is advantageously ensured that the machine states, that is to say the printing unit states during the recording of the error image and during the subsequent print, are identical as far as possible, if they have any influence on the location of the error. If there is no influence on the location of the error which occurs, taking account of the respectively prevailing machine states during the recording of the error image and during the subsequent print is unimportant.

I claim:

1. A method of correcting local, machine-based inking errors in a rotary printing machine, which comprises the following method steps:

determining an inking behavior of a printing unit by means of test forms;

registering inking nonuniformities on the test forms and transmitting data concerning the inking nonuniformities to a pre-press stage; and modifying raster tonal values of the color separations of a printing form such that the inking nonuniformities are anticipated locally based on a location of their occurrence in the print on the printing forms or printing films.

2. The method according to claim 1, wherein the printing unit has a maximum format and the inking behavior of the printing unit is determined with test forms for the maximum format.

3. The method according to claim 1, wherein the printing machine has a plurality of printing units and the method comprises, if inking nonuniformities occur independently of the printing units, the inking nonuniformities are determined on one representative printing unit.

4. The method according to claim 1, which comprises, in case of subject-dependent inking nonuniformities, modifying the color separations of the printing plate or printing film based on the subject, by utilizing one of the data, image, and color separation data.

5. The method according to claim 1, which comprises transmitting the determined inking characteristics of the printing machine to the pre-press stage in the form of an inking standard.

6. The method according to claim 1, which comprises transmitting the determined inking characteristics of the printing machine to the pre-press stage in the form of a profile.

7. The method according to claim 6, which comprises transferring the profile in tabular form.

8. The method according to claim 6, which comprises matching a resolution of the profile to error gradients of the inking nonuniformities.

9. The method according to claim 1, which comprises maintaining the modification of the raster tonal values when predefining the raster tonal values during production of the printing plate.

10. The method according to claim 1, which comprises carrying out the modification of the raster tonal values directly during an image-setting operation in a digital printing plate/film exposer.

11. The method according to claim 1, which comprises carrying out the modification of the raster tonal values directly during a direct imaging process in the machine.

12. A method of correcting local, machine-based inking errors in a rotary printing machine, which comprises the following method steps:

determining an inking behavior of a printing unit by running a suitable print job;

registering inking nonuniformities caused during the print job and transmitting data concerning the inking nonuniformities to a pre-press stage; and modifying raster tonal values of the color separations of a printing form such that the inking nonuniformities are anticipated locally based on a location of their occurrence in the print on the printing forms or printing films.

* * * * *